US007674966B1

(12) United States Patent
Pierce

(10) Patent No.: US 7,674,966 B1
(45) Date of Patent: Mar. 9, 2010

(54) SYSTEM AND METHOD FOR REALTIME SCORING OF GAMES AND OTHER APPLICATIONS

(76) Inventor: Steven M. Pierce, 66 Maple St., Enfield, NH (US) 03748

( * ) Notice: Subject to any disclaimer, the term of this patent is extended or adjusted under 35 U.S.C. 154(b) by 1067 days.

(21) Appl. No.: 11/134,777

(22) Filed: May 20, 2005

Related U.S. Application Data

(60) Provisional application No. 60/573,445, filed on May 21, 2004.

(51) Int. Cl.
*A63H 5/00* (2006.01)

(52) U.S. Cl. ..... 84/609; 84/610; 84/612; 84/622; 84/625

(58) Field of Classification Search ..... 84/609, 84/610, 612, 622, 625
See application file for complete search history.

(56) References Cited

U.S. PATENT DOCUMENTS

| | | | | |
|---|---|---|---|---|
| 5,315,057 | A | 5/1994 | Land et al. | |
| 5,753,843 | A * | 5/1998 | Fay | 84/609 |
| 5,952,599 | A * | 9/1999 | Dolby et al. | 84/649 |
| 5,990,884 | A * | 11/1999 | Douma et al. | 715/716 |
| 6,433,266 | B1 | 8/2002 | Fay et al. | |
| 6,541,689 | B1 * | 4/2003 | Fay et al. | 84/601 |
| 6,608,249 | B2 | 8/2003 | Georges | |
| 6,915,261 | B2 * | 7/2005 | Barile | 704/265 |
| 7,227,074 | B2 * | 6/2007 | Ball | 84/609 |
| 2003/0013497 | A1 * | 1/2003 | Yamaki et al. | 455/567 |
| 2003/0037664 | A1 * | 2/2003 | Comair et al. | 84/609 |
| 2003/0159567 | A1 * | 8/2003 | Subotnick | 84/626 |
| 2003/0199295 | A1 * | 10/2003 | Vancura | 463/16 |
| 2005/0144002 | A1 * | 6/2005 | Ps | 704/266 |
| 2005/0241465 | A1 * | 11/2005 | Goto | 84/616 |
| 2006/0163358 | A1 * | 7/2006 | Biderman | 235/472.01 |

OTHER PUBLICATIONS

Steven M. Pierce, Theory and Design of an Automated Film Scoring Application, Master Thesis, Department of Music, Aug. 2000, 79 pages, University of Leeds, UK.
ZenStrings, www.zenstrings.com, Publication Date Prior to Earliest Filing Date of May 21, 2004.

* cited by examiner

*Primary Examiner*—Walter Benson
*Assistant Examiner*—Kawing Chan
(74) *Attorney, Agent, or Firm*—William A. Loginov; Loginov & Associates, PLLC

(57) ABSTRACT

The invention provides a software framework that allows real-time computer-generated music to be used in interactive applications, particularly video games, by "modularizing" music-producing and music-modifying computer procedures into musically logical and programmatically convenient structures, as well as providing a communication mechanism between the application and the music-generating system which will allow the music to reflect the appropriate mood given the current application state.

20 Claims, 6 Drawing Sheets

SYSTEM AND METHOD FOR REALTIME SCORING OF GAMES AND OTHER APPLICATIONS

CROSS-REFERENCE TO RELATED APPLICATION

The present application claims the benefit of U.S. Provisional Patent Application Ser. No. 60/573,445, which was filed on May 21, 2004, by Steven M. Pierce for a SYSTEM AND METHOD FOR REALTIME SCORING OF GAMES AND OTHER APPLICATIONS and is hereby incorporated by reference.

BACKGROUND OF THE INVENTION

1. Field of the Invention

This invention relates to computer software for composing real-time musical soundtracks for interactive applications.

2. Background Information

Musical scores play an important role in a user's experience of interactive applications (including, but not limited to, video games). The video game industry in particular has struggled to find a mechanism capable of providing dynamic musical scores that are relevant both to the action and emotional context of the game. Real-time, computer-generated music has so far not been employed in a way that makes use of its full capabilities for interactivity or emotionally relevant musical scoring. The present system has many advantages over current dynamic and non-dynamic music systems.

Current non-dynamic computer-generated music scoring systems (Zen Strings [www.zenstrings.com], Automatic Soundtrack Generator [U.S. Pat. No. 6,608,249], or Scorebot [Master's Thesis submitted to the University of Leeds, UK, August 2000 by Steven M. Pierce]) are designed to provide computer-generated music for accompaniment purposes, but are not designed to respond to real-time input. The scores they generate are possibly unique from one instance of running the program to the next, but not unique to a particular user's interaction with the environment in question. One cannot, as a system user, expect musical change in real-time according to user actions.

Current dynamic music systems (for example, LucasArts dynamic music system [U.S. Pat. No. 5,315,057], Microsoft's DirectMusic [U.S. Pat. No. 6,433,266], Nintendo's interactive music system [US Patent Application #20030037664]), and other current methods employed by the industry depend on pre-recorded musical chunks that are re-combined in real-time to create variation. This is inherently limited and cannot address the full potential of computer music possibilities in offering theoretically infinite and emotionally relevant variation. It is also a labor-intensive process to have to pre-compose the musical variations and assign them to be played by the system in particular situations. Hence an easier-to-use and more-powerful solution to real time scoring of media applications is highly desirable.

SUMMARY OF THE INVENTION

This invention overcomes the disadvantage of the prior art by providing a system and method for scoring of interactive applications, such as electronic (video) games that uses software to generate musical scores in real-time based on information provided by the game environment that indicates the current "mood" that should be evoked. The game communicates with the music system via messages. These messages are interpreted by the system which is responsible for executing component programs that generate and modify note data in real-time. The musical score (also termed "automated music") is the result of the output of these component programs (in the form, generally of note data) being sent to a sound synthesis mechanism (also termed a "software synthesizer") that may be included with this system or may reside on the hosting platform. These component programs achieve this result by using procedures that generate note data conforming to desired musical motifs, and which map the mood information provided by the game environment onto this note data, so that the score will always reflect the current state of the game (mood, user preferences, etc).

The proposed system and method has the following benefits. It provides:

a. Dynamic music: real-time musical response to user input and game action.
b. Non-Repetitive music: potentially unlimited variation in musical score.
c. Computer-generated music: no need to prerecord musical variations.
d. Many modes of variation: music can change with respect to game environment, character presence, user preferences, or anything else.
e. Transitions handled dynamically: transitions between themes or variations, including beginnings and endings are smooth and musical.
f. System independence: the system can work with other systems or more traditional scoring mechanisms.

Alternatively, the invention is characterized as a music scoring system having an analysis process that analyzes interactive applications operating in conjunction with a platform and that derives predetermined characteristics from portions of the application and a music generation process that, in response to the analysis process, generates automated music so as to provide a soundtrack that plays in accordance with the predetermined characteristics during operation of the portions. In an illustrative embodiment, the analysis process includes an Orchestrator class that intercepts messages from the application and is constructed and arranged to select at least one of a plurality of appropriate Themes, Variations and Transitions based upon each of the messages. A lookup table structure contains selection criteria for applying the Variations to Themes. To this end, the Orchestrator communicates with the lookup table to retrieve the criteria in response to at least some of the messages. Moreover, the lookup table structure can include at least one of (a) predefined selection criteria, and (b) user customizable criteria adapted to be established to correspond to the predetermined characteristics. In one embodiment, messages sent from the enveloping application can include (a) Theme messages that indicate a new motif should be played and a Theme-to-Theme Transition should be executed between changing themes, (b) Mood messages that indicate that at least one of the plurality of Variations should be applied to alter the character of the Theme/motif (along with a relevant Transition for the Variation, and (c) Custom messages that trigger predetermined/preprogrammed results of a user's/designers choice. In addition there is a Note Generator class that encapsulates a Theme class and the current Variations and Transitions as required. The note generator is constructed in response to the Orchestrator.

BRIEF DESCRIPTION OF THE DRAWINGS

The invention description below refers to the accompanying drawings, of which.

DETAILED DESCRIPTION OF AN ILLUSTRATIVE EMBODIMENT

I. Description of the Invention

The invention described according to an illustrative embodiment herein is a system for real-time composition of automated musical scores (also termed "automated music" or "algorithmic music") to be played as accompaniment to interactive media. It can be implemented as electronic hardware, software, including program instructions executing on a computer, or a combination of hardware and software. For purposes of this discussion, it is assumed that the interactive medium in question is a video game, although the applications of this technology are not limited to games; the technology may be applied to any software-based (or hardware-based) system that needs dynamic and/or non-repetitive musical accompaniment. Briefly, the system is a framework that provides the following desirable characteristics:

- music produced in real-time on a note-by-note basis allowing it to be both non-repetitive (where random functions are used) and responsive to changes in the game environment in an emotionally meaningful and musically logical way;
- musical information and operations codified into software components for ease of programming, reuse, and maintenance;
- system independence, in that the system is purely software based and can be implemented on any hardware or software platform where interactive music is desired; and
- expandability in the sense that any known (or as yet unknown) procedural music composition technique may be accommodated by the system.

In the illustrative embodiment, the musical score is thought of as a collection of "themes and variations." The themes are the raw musical material of a score, and the information in a theme can be "sonified", or converted into sound. The variations modify theme information dynamically, changing some aspect of the music before it is sonified. Events in the game trigger different variations, and the result is a musical score that is customized to the context of the game. As described below, the context of the game is termed its "mood."

Figure 6:
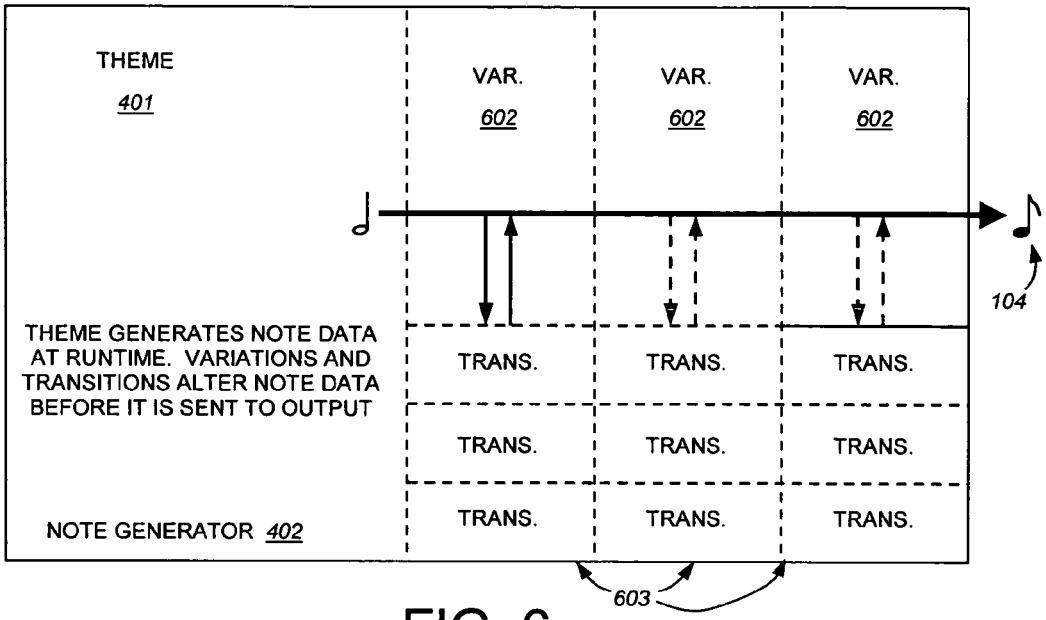
FIG. 6 is a block diagram of a Note Generator containing a Theme and zero or more Variations and Transitions in accordance with an embodiment of this invention.

Real-time musical scores shall be defined as music generated in perceptual real-time that accompanies streams of non-musical information. In general, processes dynamically choose both the notes to be played and the instruments on which to play them. (The notes are most likely to be "sonified" on a conventional software synthesizer—not described herein). In the present embodiment, the notes are not chosen completely randomly. Instead, they are based on pre-programmed "Theme" processes, which may or may not include randomness. In other words, a programmer provides a database or listing of ordered notes that are associated with one or more parameters (such as the Theme) as described herein that are used to categorize the notes and retrieve them for inclusion in the soundtrack at appropriate times. The retrieved notes are further modified in real-time by "Variation" and "Transition" processes to match the current mood and achieve smooth, musical transitions. These processes are designed to execute concurrently, and a collection of a Theme with various Variations and Transitions will be referred to as a "Note Generator" 402 (see FIG. 6). All of these concepts (e.g. Themes, Variations, and Transitions) should ideally be implemented as "classes" in an object-oriented programming language, although this is not a requirement.

Figure 4:
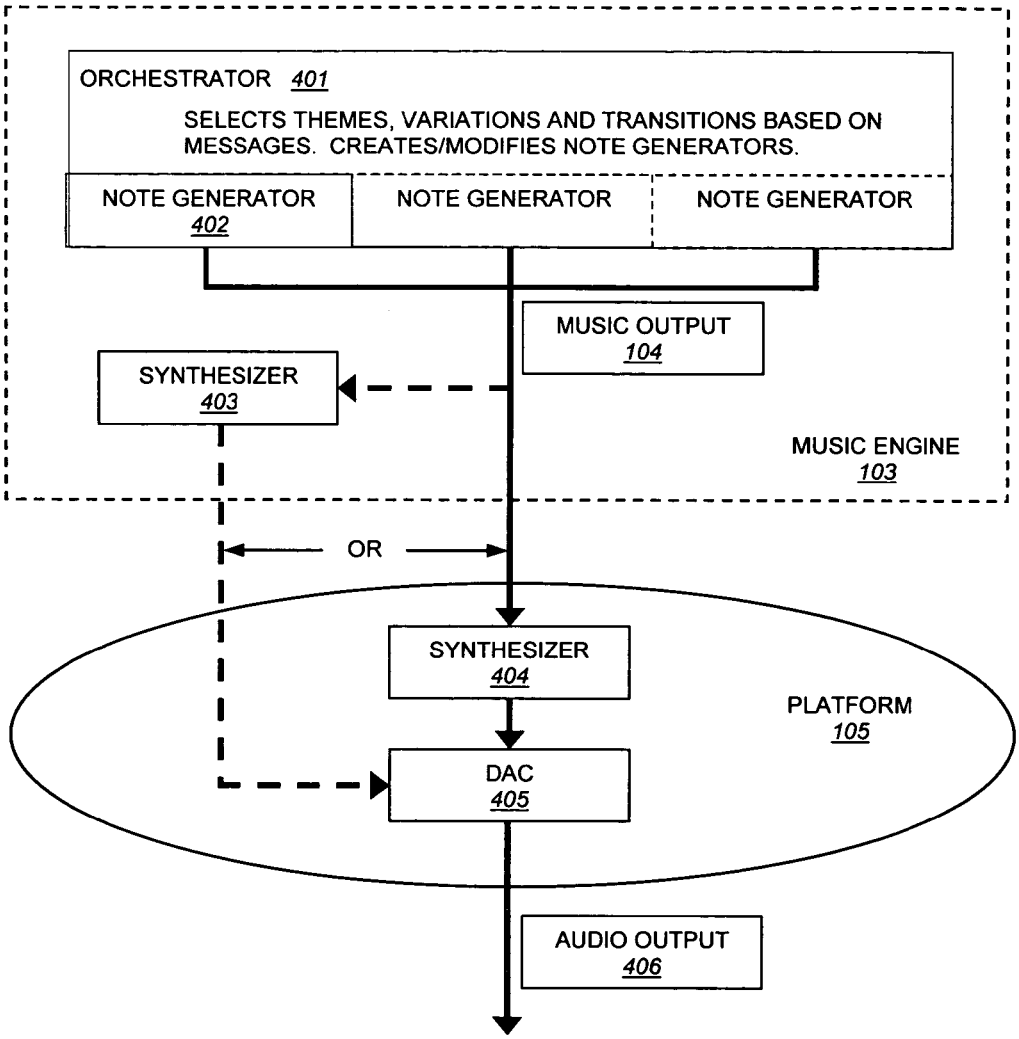
FIG. 4 is block diagram of the structure of the MusicEngine and its relationship to the platform, wherein the MusicEngine contains the Orchestrator and an optional software synthesizer in accordance with an embodiment of this invention.
Figure 5:
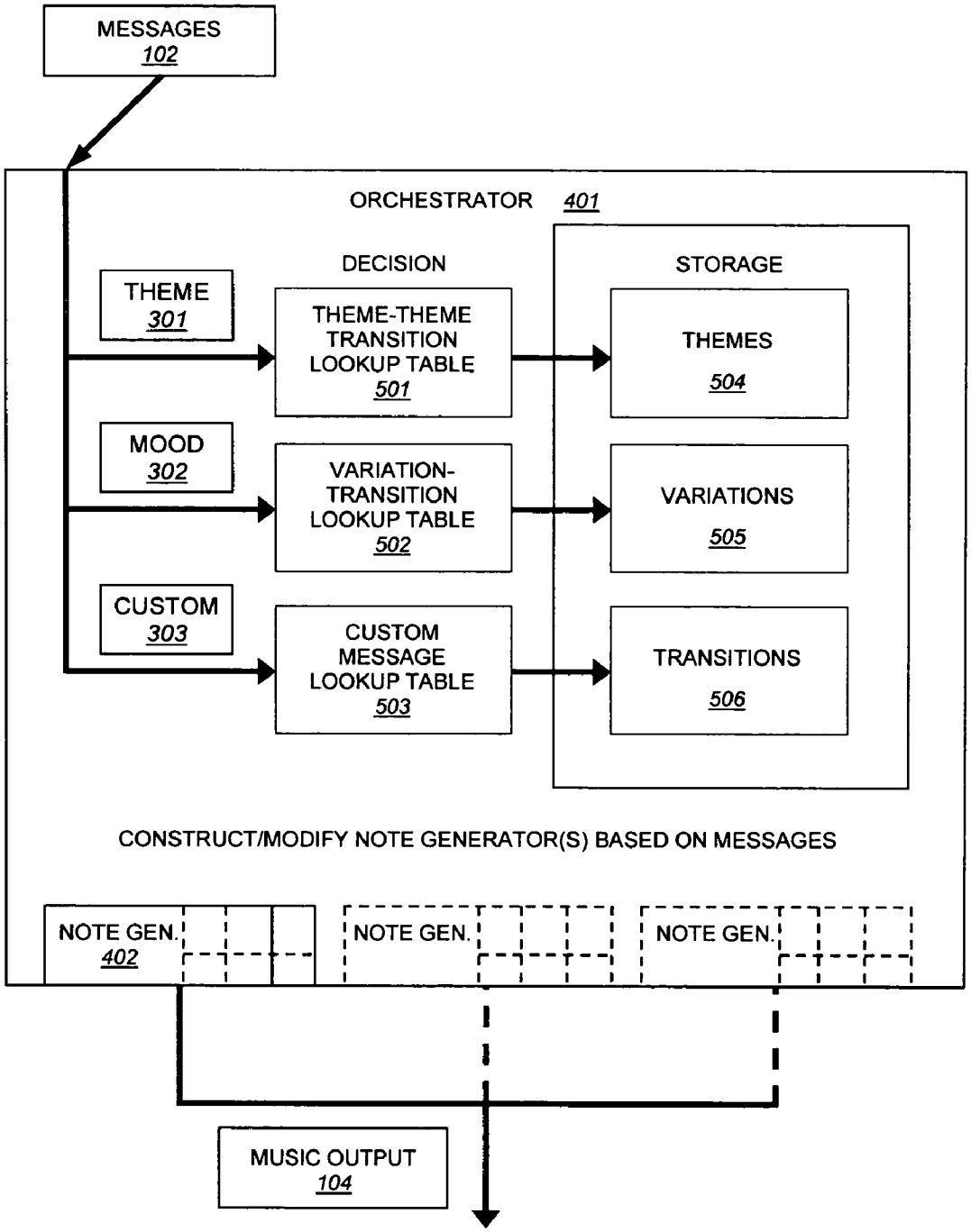
FIG. 5 is a block diagram of the structure of the Orchestrator, showing its use of lookup tables to handle incoming messages in accordance with an embodiment of this invention.

Note Generators are created, modified, and destroyed by an "Orchestrator" 401 (see FIG. 5). The Orchestrator's task is to receive messages 102 about the mood and state of a game and create an appropriate score. For the most part, the Orchestrator responds to game events by either creating a new Note Generator 402 or by modifying an existing Note Generator through a Variation 602. The software elements that comprise the current invention are contained in a unit called the "MusicEngine" 103 (see FIG. 4).

Figure 1:
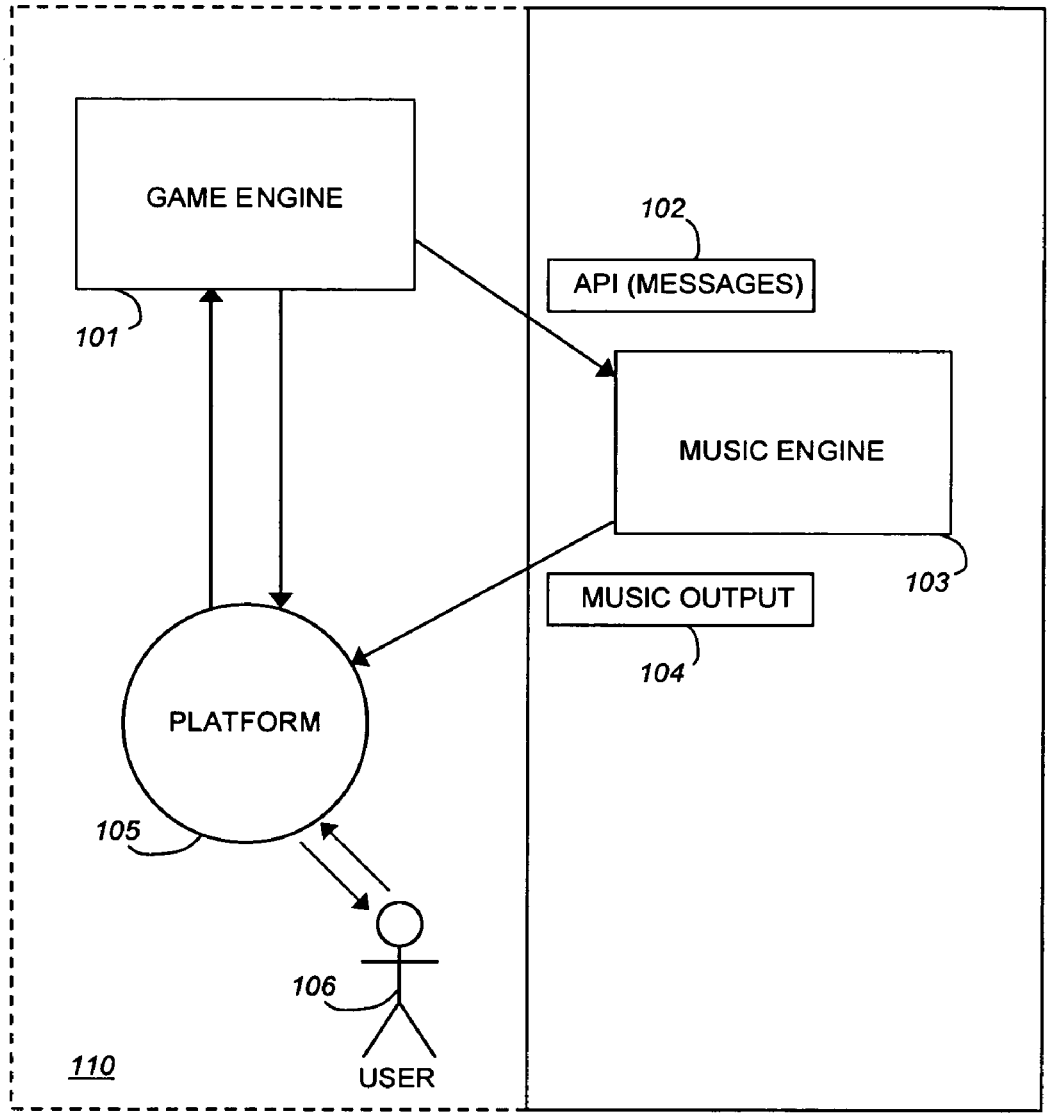
FIG. 1 is schematic diagram of an overview of the system and method of this invention in the context of the encompassing interactive application and platform, thereby illustrating the relationship between the system and method and the prior art.

Referring now to FIG. 1, an overview of the system, according to an embodiment of this invention is shown. The MusicEngine 103 exists as a software layer between the game (software) 101 and the platform 105 hardware's audio outputs 406 (see FIG. 4). These elements can be composed of conventional and/or prior/art components 110. A software synthesizer may be available on the particular platform 404 (See FIG. 4), although it is not necessary and is, thus, optional. If a synthesizer is not available in the platform 105, a software synthesizer 403 may be included in the MusicEngine.

Figure 3:
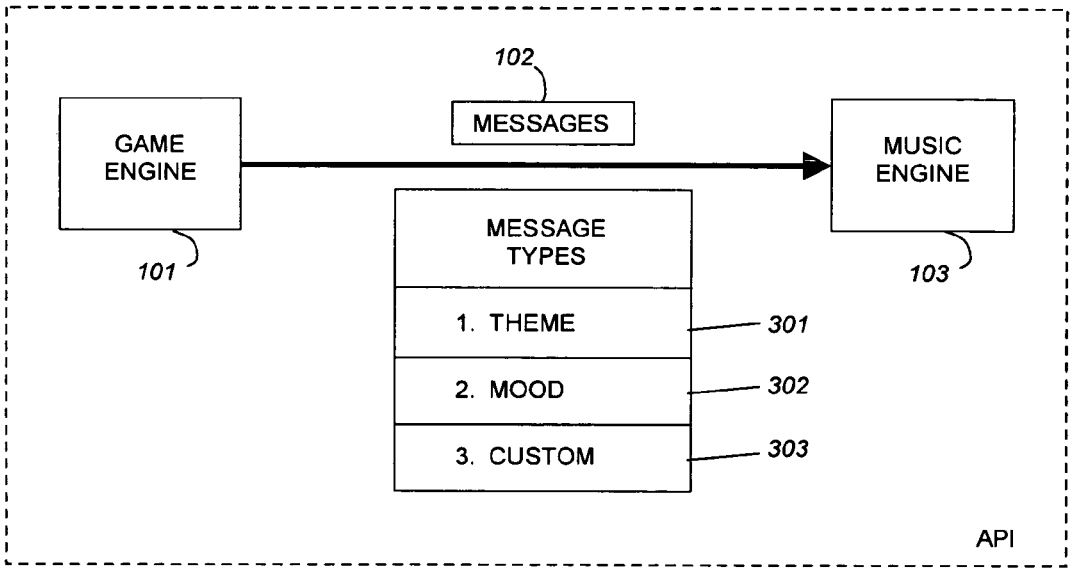
FIG. 3 is block diagram of the Application Programmer's Interface (API), which consists of three types of messages that can be sent from the GameEngine to the MusicEngine: Theme, Mood, and Custom Messages in accordance with an embodiment of this invention.

The MusicEngine 103 according to this invention receives messages 102 from the encompassing environment. For the purposes of this description, the encompassing environment is referred to as the "GameEngine" 101. The messages sent by the GameEngine to the MusicEngine conform to a conventional-style API, or Application Programmer's Interface (see FIG. 3). As an example, if the GameEngine 101 requires the music to change mood, it sends a mood message 302 (see FIG. 3) to the MusicEngine. The MusicEngine forwards the message to the Orchestrator 401, and the Orchestrator modifies the mood of the music via the construction, destruction or modification of NoteGenerators 402. Note that the decision of how the music should change is left up to the Orchestrator; the GameEngine decides basically when a change should occur.

The procedures that make up the Theme, Variation, and Transition programs can be constructed by utilizing any one of a number of computer-music composition techniques that are widely available, or by original methods that can be added to this system over time. As the system is modular, it should be extensible. The programs can be written in such a way as to achieve the desired musical result for a particular application, or "generic" functions can be provided for general use.

Figure 2:
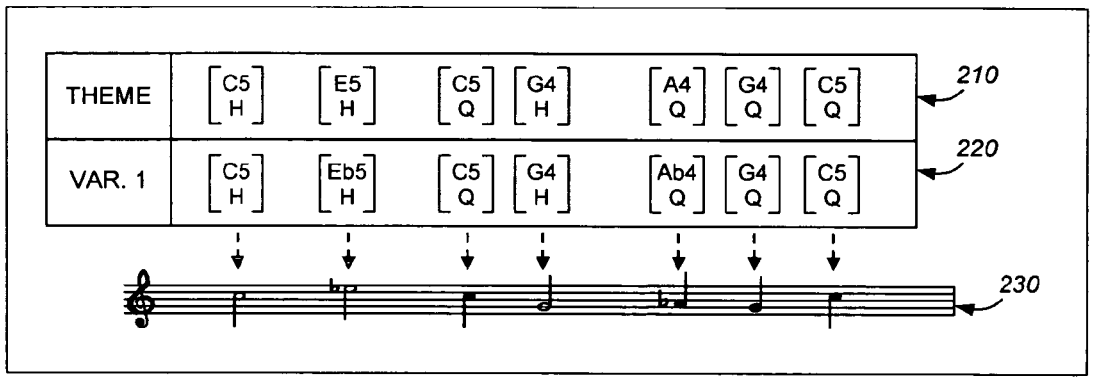
FIG. 2 is diagram showing an example of the interaction of a possible Theme program and a Variation program as well as the resulting automated musical output in common notation according to an embodiment of this invention.

Before discussing these components in more detail, a brief example is provided to illustrate the basic relationship of the Theme and Variation programs. FIG. 2 shows the components a NoteGenerator comprising a Theme 210 whose exemplary program is to "generate notes in the key of C as quarter notes or half notes" (leaving the question of tempo aside for the moment) and a Variation whose program is to "make the key minor". The Theme generates data in real-time (shown is a seven note sequence), and this information is passed through the Variation 220 which, in this case, "flats" the E and A. The Theme 210 makes certain properties about itself known to the Variation 220 (in this case: musical key). Once all the NoteGenerator's component Theme and Variation programs have been executed on the note data, the data can be passed on to a synthesizer for "sonification". Each note is sonified in turn, and then the next note is chosen, and so on. The bottom line 230 in FIG. 2 shows the musical output that the user will hear in common musical notation.

In general, by way of definition, a Theme is characterized as a main musical motif for the operating application or relevant portion thereof. This can be considered a main song, tune, musical work or musical passage with various instrumental and/or choral components. A Variation is characterized as vehicle by which the mood of a motif or Theme can be altered to fit the characteristics of the relevant portion of the application. Some examples of Variations that can operate on a motif are changing of a motifs scale from major to minor (and vice versa), altering loudness of the motif at a certain point, changes in instrumentation at a point, and the like. A Transition is an operation that is selectively applied to a Variation to ensure that a desired degree of musical smoothness occurs. For example, where a loudness change is required, a linear or logarithmic curve may be used to implement the Variation so that it is not (or is) sudden. Of course, an application may include more than one Theme or motif, to delineate, for example, different sections, chapters or parts of a game, or other display. In this case special Theme-to-Theme Transitions may be defined and employed. Such Special Transitions may include an interim Theme that is particularly recorded for this purpose or a generic "cross-fade" between two motifs/Themes using (for example) conventional music-synthesis techniques.

The details of the various elements mentioned above are now described. The API is discussed first, since it defines the interface a game will use to interact with the invention.

II. API

The API (FIG. 3) defines the format for the messages 102 that the GameEngine 101 uses to communicate its state to the MusicEngine 103. There are three types of messages: Theme Messages 301, Mood Messages 302, and Custom Messages 303. They are described in detail below.

1. Theme Message

The Game Engine 101 includes an analysis process that uses Theme Messages to instruct the MusicEngine 103 to start another Theme 601 program. As an example, suppose a game programmer wants a different musical idea at every level of the game. In this case, the programmer would have the GameEngine send a Theme Message to MusicEngine at the start of a new level. The Orchestrator 401 responds to a Theme Message by stopping the current Theme and starting a new Theme; the details of this transition are discussed in Section IV below. The Theme Message may contain a reference to a particular Theme to be played, or a pointer to a function that would determine an appropriate Theme based on certain parameters.

2. A Mood Message

A Mood Message 302 is used by the GameEngine 101 to indicate a condition has occurred affecting the mood (emotional quality and intensity) of the current situation. An example of a mood message could be "Happy 5," where "Happy" indicates the emotional quality and "5" refers to the intensity of that emotion on a scale from 1 to 10. The GameEngine may send as many Mood Messages as it desires in any situation; it is the business of the Orchestrator 401 to manage the messages and determine the appropriate musical response.

Mood Messages come in two types: dual messages and single messages.

A. A Dual Message

The dual message is an "on/off" pair. If the GameEngine 101 sends an "on" message for a certain mood, then it also needs to send an "off" message for that mood. Additionally, if the Orchestrator 401 schedules Variation 1 in response to a mood "on" message, it needs to cancel the execution of Variation 1 when it receives the "off" message.

B. Single Message

A single message is basically an "on" message with no corresponding "off" message. Instead, the single message contains a duration parameter, and the Orchestrator 401 will score the mood change for the specified duration. Single messages are a simpler alternative to dual messages and can be used in any situation where the duration of the event is known in advance.

3. Custom Message

A Custom Message 303 is any type of message that the MusicEngine 103 can be programmed to understand. These custom messages are determined on a case-by-case basis according to the game being scored.

III. MusicEngine

The MusicEngine 103 (see FIGS. 1 and 4) is a software environment that is designed to run along side another application, such as the GameEngine 101, and receive messages 102 that conform to the API. When the MusicEngine receives a message, it passes the message off to the Orchestrator 401 that executes the analysis process and a music generation process according to this invention. The MusicEngine is also responsible for knowing how to communicate the output of NoteGenerators 402 to a sound-producing device on the native platform (for example, a software synthesizer) 404. Where no such synthesizer exists, the MusicEngine can be designed to contain an embedded software synthesizer 403. This is the above-referenced music-generation process that reacts to the analysis process.

IV. Orchestrator

The Orchestrator's 401 task is to react to API messages 102 in a musically meaningful way. This can be characterized as the analysis process in which portions of the game are analyzed for predetermined characteristics and thereby provide a basis to be acted upon to generate automated music. If the Orchestrator receives a Theme Message 301, the Orchestrator must schedule a new Theme for execution and determine how to transition to the new Theme. If it receives a Mood Message 302, the Orchestrator selects appropriate Variation and Transition programs for that mood. One way the Orchestrator can determine which moods map to which programs is through the use of pre-defined lookup tables 501,502,503.

As an example, suppose Theme 1 is currently executing and the Orchestrator 401 receives a Theme Message 301 to start Theme 2. The Orchestrator looks at the (1, 2) entry in its Theme-Theme Transition lookup table 501 and determines that Transition 1 will work for a Theme 1 to Theme 2 transition. The Orchestrator will also need a lookup table 502 (see FIG. 5) to match Variations with Transitions.

The lookup tables 501, 502, 503 (FIG. 5) and other data structures 504, 505, 506 can contain both pre-defined information as well as information specified by a game programmer. The exact contents of the tables will be determined on a case-by-case basis: a convenient method should be provided for game programmer's to accomplish this, such as a separate application with a Graphical User Interface. In general, the lookup tables contain references to a range of possible Theme, Variation, and Transition programs that are appropriate in a given situation, depending on the Orchestrator's 401 interpretation of the messages 102.

At a minimum the Orchestrator 401 typically contains the following data structures:

1. Theme Vector 504 (a collection of objects defining musical motifs);
2. Variation Vector 505 (a collection of objects which alter music data to match mood);
3. Transition Vector 506 (a collection of objects which alter music data according to functions over time);
4. Theme-Theme Transition Lookup Table 501 (used for Theme Messages 301);
5. Variation-Transition Lookup Table 502 (used for Mood Messages 302); and
6. Custom Message Lookup Table 503 (used for Custom Messages 303)

The Lookup Tables 501, 502, 503 may be multi-dimensional to handle the "quality" and "intensity" of mood messages 302 as separate parameters.

After the Orchestrator 401 consults a lookup table 501, 502, 503 and chooses an appropriate Theme, Variation, or Transition 601, 602, 603, it either constructs a new Note Generator 402 or modifies an existing Note Generator. In general, one Note Generator executes at a time, though in special cases the Orchestrator may choose to execute several Note Generators concurrently. One example of this special case is for a crossfade Transition. In order to crossfade between two Themes, two Note Generators execute at the same time, since a Note Generator typically can contain one Theme.

V. Note Generators

Note Generators 402 (see FIG. 6) is a name given to a collection of a Theme 601 with zero or more Variation 602 and Transition 603 programs that together generate music output 104 in real-time. Transitions operate on Variations in a many-to-one relationship, and Variations operate on Themes in a many-to-one relationship.

Themes, Variations and Transitions are defined as follows:

A. Theme

A Theme 601 is a computer process that makes note choices that conform to a particular musical idea or "motif." The Theme provides the raw data of the musical score that can then be altered in real-time by Variation 602 and Transition 603 programs to match the current mood of the game.

Themes 601 can be programmed by utilizing any imaginable kind of computer-generated music composition technique or combination of techniques. Ideally, a convenience mechanism should be provided for building these, such as a separate application with a Graphical User Interface that provides simple access to music programming components (such as scales, random functions, etc.), or, ideally, a program that can create a Theme program by analyzing a MIDI file, for example.

The Theme 601 makes certain properties about itself available, so that Variations 602 can know how to operate on them. These properties should include, but not be limited to: key, mode, tempo, and time signature. These properties should be updated in real-time, so that the correct current value is always represented.

B. Variation

A Variation 602 is a process that is designed to alter Theme 601 information in a specific way to reflect the mood information 102 corresponding to the current state of the game. The Orchestrator 401 decides during execution which Variations to execute, and the Variation is "plugged-in" to the current Theme. The Variation alters properties of notes as they are being chosen. The properties that can be altered shall at a minimum include pitch, loudness, duration and instrument. Variations can be "custom" designed to work with specific Themes, or they may be generic and able to work with any Theme that supports it.

C. Transitions

A Transition 603 is a computer process that "plugs-in" to a Variation 602 and alters notes according to some kind of scaling factor. This scaling factor is designed to work over a specific period of time. Transitions are used to implement ritards (altering the duration of notes over time to affect a gradual change in tempo), for example. Any number of Transitions might be used when any particular Variation is executed. The decision of which Transitions to use is left to the Orchestrator 401. When a Transition has run its course, the Transition simply returns the target data, thereby essentially being bypassed.

Example

An example shall serve to illustrate the interaction between Theme, Variation, and Transition programs. This is a highly simplified set of processes, but nonetheless should make the program flow clearer.

Figure 7:
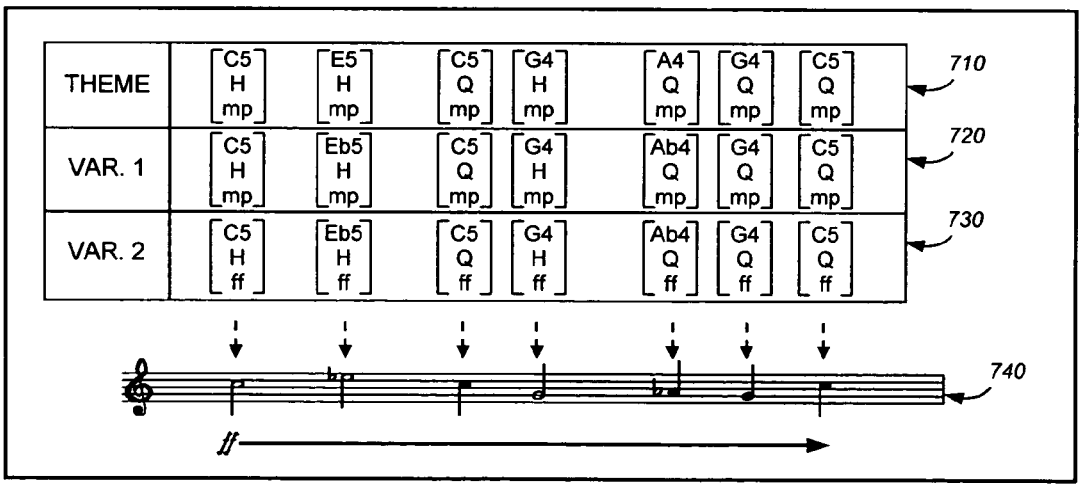
FIG. 7 is a diagram showing an example of the interaction of a possible Theme and two possible Variations 1 and 2) as well as the resulting musical output in common notation in accordance with an embodiment of this invention.

The top line in FIG. 7 shows the output of a Theme 710 whose program is the following: choose a note in the key of "C" of half or quarter note duration. Note that in the figure, time is represented from left to right and the notes are generated one at a time in real-time. The designations "H" and "Q" refer to half-note and quarter-note, respectively. Before the note is sent to the output, it passes through two Variations 720 and 730. The first Variation 720 converts the sequence of pitches to a minor key and the second Variation makes the sequence louder by changing the dynamic. Notice that the first Variation flatted the E and A from the Theme, and the second Variation converted all dynamic markings to ff. The final line 740 shows the musical output that the user hears.

Figure 8:
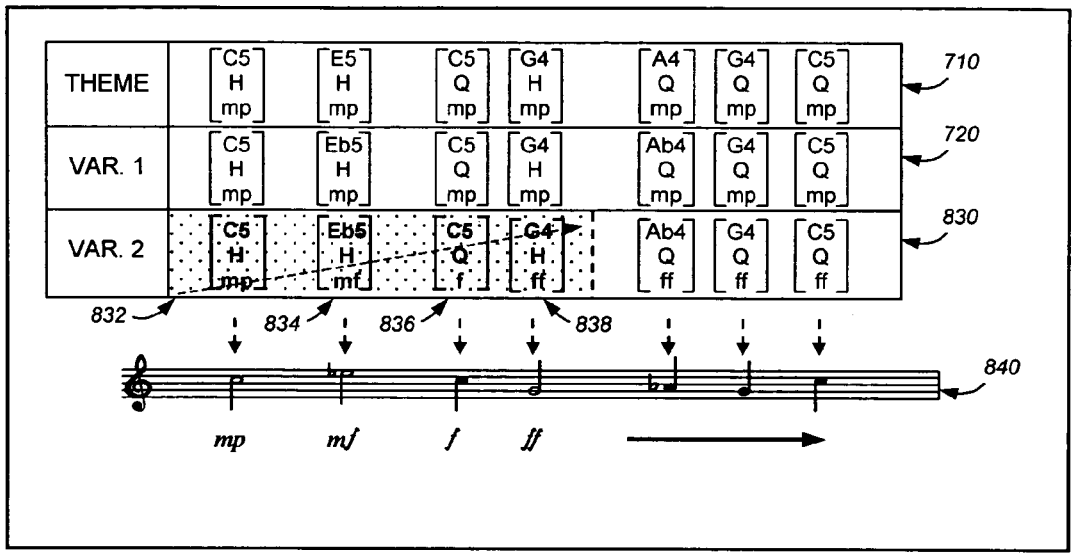
FIG. 8 is a showing the same example as FIG. 7, but with the addition of a Transition on Variation 2.

FIG. 8 illustrates the second Variation with a Transition (830). In this case, the Transition is a linear function that operates on the dynamics. Rather than immediately moving to ff, the dynamics are gradually altered from the previous state (mp) to the Variation's target state (#. The duration of the Transition in this case is such that it affects the first four notes

832, 834, 836 and 838, respectively. As a result, the user hears a gradual crescendo during the first four notes in the output 840.

VII. Special Case

Theme to Theme Transitions

Transitions from Theme-to-Theme are special cases that should be addressed separately. In the illustrative embodiment, there are two basic types of Theme-to-Theme Transitions possible given the materials presented herein:

1. A Transition effected by a combination of Variation and Transition programs on two consecutive Themes; and
2. A Transition effected by an interim Theme, used to perform complex modulations, for example.

In any case, these types of Transitions are handled via the tools available as outlined above, and no further special mechanism need be provided.

VIII. Summary

The above text describes a framework for computer procedures to produce dynamic, real-time, non-repetitive, emotionally relevant, and musically logical scores for interactive applications. The framework is structured in such a way as to "modularize" the musical information and operations in a musically logical way for the convenience both the application programmers and the composers. The system is capable of being responsive to the application environment and user interaction as well as providing non-repetitive music to the greatest extent possible.

The embodiment described above represents the preferred mode for implementation of this invention. The particular software "modules", divided into the specific component programs outlined herein (Orchestrator, Theme, Variation, etc.), are not required, however. The same functionality could be achieved by structuring the procedures in another way. Generally the system should be capable of executing procedures that generate musical information in real-time and can be modified to reflect the game state and then sonified in some way. Also, it should be clear that the system can work with any interactive application, or even non-interactive applications where non-repetitive music is desired. Thus, the term "application" should be taken broadly to include both interactive and non-interactive enveloping applications unless otherwise limited.

The foregoing has been a detailed description of an illustrative embodiment of the invention. Various modifications and additions can be made thereto without departing from the spirit and scope thereof. For example, it is expressly contemplated that additional parameters can be applied in selecting transitions between notes and musical passages in accordance with further embodiments. Accordingly, this description is meant to be taken only by way of example and not to otherwise limit the scope of this invention.

What is claimed is:

1. A method for scoring an application comprising the steps of:

continuously determining a "mood" class of the application representing its current state at any given time;

executing at least one of a plurality of predetermined musical scoring procedures responsive to the mood class in real-time to generate a musical score customized to the mood class of the application, thereby providing a unique soundtrack that is constructed and arranged to be modified according to a user's interaction with the application; and generating the musical score using a note generator procedure that generates and modifies each of the notes one note at a time in real-time according to the user's interaction with the application as determined by the mood class of the application, so as to provide the unique soundtrack such that each note is generated one at a time in real-time prior to being sonified by a software synthesizer so as to create the unique soundtrack.

2. A music scoring system comprising:

an analysis process that analyzes an application operating in conjunction with a platform and that derives predetermined characteristics from portions of the application;

a music-generation process that, in response to the analysis process, generates automated music in real-time so as to provide a unique soundtrack that plays in accordance with the predetermined characteristics during operation of the portions; and a note generator process that generates the automated music in real-time by generating the notes one at a time according to the predetermined characteristics during operation of the portions.

3. The music scoring system as set forth in claim 2 wherein the analysis process is constructed and arranged to derive the predetermined characteristics in real-time as the portions operate and the music-generation process generates the automated music in real-time to play in conjunction with the operation of the portions.

4. The music scoring system as set forth in claim 3 wherein the analysis process is constructed and arranged to derive the predetermined characteristics in response to messages generated by the application in conjunction with at least some of the portions.

5. The music scoring system as set forth in claim 4 wherein the analysis process includes an Orchestrator class that intercepts messages from the application and is constructed and arranged to select at least one of a plurality of appropriate Themes, Variations and Transitions based upon each of the messages.

6. The music scoring system as set forth in claim 5 further comprising a lookup table structure containing selection criteria for applying the Variations to Themes and wherein the Orchestrator communicates with the lookup table structure to retrieve the criteria in response to at least some of the messages.

7. The music scoring system as set forth in claim 6 wherein the lookup table structure includes at least one of (a) predefined selection criteria and (b) user customizable criteria adapted to be established to correspond to the predetermined characteristics.

8. The music scoring system as set forth in claim 4 wherein the messages each contain predetermined data related to a corresponding mood of each of the portions.

9. The music scoring system as set forth in claim 2 wherein the music-generating process includes a plurality of modules adapted to allow the automated music to be generated in an intuitive, flexible and musically logical manner.

10. The music scoring system as set forth in claim 9 wherein the plurality of modules include modules that define a Theme and modules that vary the Theme.

11. The music scoring system as set forth in claim 10 wherein the Theme corresponds to a predetermined musical motif.

12. The music scoring system as set forth in claim 11 wherein the modules that vary the Theme include Variations that react to mood data from the application and Transitions that smoothly implement the variations in real-time.

13. The music scoring system as set forth in claim 12 wherein Variations are adapted to alter a mood of the Theme.

14. The music scoring system as set forth in claim 13 wherein the Variations are constructed and arranged to, at least one of, change a scale from major to minor, alter loudness and change instrumentation.

15. The music scoring system as set forth in claim 14 wherein the Transitions are adapted to modify a variation to generate a unique musical effect.

16. The music scoring system as set forth in claim 15 further comprising another Theme that operates in predetermined portions of the application and wherein the Transitions include Special Transitions that operate between at the Theme and the other Theme.

17. The music scoring system as set forth in claim 16 further comprising messages sent from the application including (a) Theme messages that indicate a new motif should be played and a Theme-to-Theme Transition should be executed between changing Themes, (b) Mood messages that indicate that at least one of the plurality of Variations should be applied to alter a musical motif Variation, and (c) Custom messages that trigger predetermined results of a user's choice.

18. A system for real-time scoring of an application comprising:

an analysis process that analyzes the application operating in conjunction with a platform and that derives predetermined characteristics from operation of portions of the application;

a music-generation process that generates automated music dynamically on a note-by-note basis to provide a unique soundtrack that is constructed and arranged to be modified in accordance with the predetermined characteristics during operation of the portions of the application;

a note generator process that generates the automated music in real-time by modifying each of the notes one at a time by executing at least one of a theme program, a variation program and a transition program;

wherein the theme program provides a collection of notes defining musical motifs of the predetermined characteristics;

wherein the variation program alters the musical motifs to match a mood of the application; and wherein the transition program alters the musical motifs according to a function over time, thereby changing the notes one at a time over time to generate a transition in the automated music.

19. The system as set forth in claim 18 wherein the analysis process is constructed and arranged to determine the mood class in response to messages generated by the application and includes an Orchestrator class that intercepts messages from the application and selects at least one of a plurality of appropriate Themes, Variations and Transitions based upon each of the messages.

20. The system as set forth in claim 18 wherein the music-generation process includes a plurality of modules adapted to allow the automated music to be generated in an intuitive, flexible and musically logical manner.

* * * * *